US010155636B2

(12) United States Patent
Kuwata et al.

(10) Patent No.: US 10,155,636 B2
(45) Date of Patent: Dec. 18, 2018

(54) IMAGE FORMING APPARATUS

(71) Applicant: CANON KABUSHIKI KAISHA, Tokyo (JP)

(72) Inventors: Takashi Kuwata, Suntou-gun (JP); Motoyasu Muramatsu, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/797,804

(22) Filed: Oct. 30, 2017

(65) Prior Publication Data

US 2018/0050880 A1 Feb. 22, 2018

Related U.S. Application Data

(63) Continuation of application No. 14/764,538, filed as application No. PCT/JP2014/000235 on Jan. 18, 2014, now Pat. No. 9,828,200.

(30) Foreign Application Priority Data

Jan. 31, 2013 (JP) ..... 2013-017122

(51) Int. Cl.

| | |
|---|---|
| ***B65H 29/68*** | (2006.01) |
| ***G03G 15/00*** | (2006.01) |
| ***B65H 7/20*** | (2006.01) |
| ***B65H 7/02*** | (2006.01) |
| ***B65H 3/52*** | (2006.01) |

(Continued)

(52) U.S. Cl.

CPC ..... *B65H 7/20* (2013.01); *B65H 3/0669* (2013.01); *B65H 3/0684* (2013.01); *B65H 3/5215* (2013.01); *B65H 3/5261* (2013.01); *B65H 5/062* (2013.01); *B65H 5/068* (2013.01); *B65H 7/02* (2013.01); *G03G 15/6511* (2013.01); *G03G 15/6529* (2013.01); *G03G 15/6564* (2013.01); *B65H 2220/11* (2013.01); *B65H 2403/732* (2013.01); *B65H 2511/11* (2013.01); *B65H 2513/108* (2013.01); *B65H 2513/53* (2013.01); *B65H 2701/1311* (2013.01); *G03G 2215/00405* (2013.01); *G03G 2215/00409* (2013.01); *G03G 2215/00945* (2013.01)

(58) Field of Classification Search

CPC ..... B65H 7/20; B65H 2513/108; G03G 2215/00945; G03G 2215/00409; G03G 15/6558

See application file for complete search history.

(56) References Cited

U.S. PATENT DOCUMENTS 5,472,183 A * 12/1995 Kubo ..... B65H 1/08 271/110
2005/0189707 A1* 9/2005 Sano ..... B65H 5/062 271/242

(Continued)

FOREIGN PATENT DOCUMENTS

JP 08225173 A * 9/1996
JP 2000177863 A * 6/2000

*Primary Examiner* — Blake A Tankersley
*Assistant Examiner* — Ruben C Parco, Jr
(74) *Attorney, Agent, or Firm* — Canon U.S.A., Inc. IP Divison

(57) ABSTRACT

The present invention provides an image forming apparatus that reduces image artifacts caused by the back tension of a separating unit. A control unit decreases the number of rotations (the rotational speed) of a resist roller pair after the leading edge of a sheet reaches a transfer position.

21 Claims, 14 Drawing Sheets

(51) Int. Cl.
*B65H 5/06* (2006.01)
*B65H 3/06* (2006.01)

(56) References Cited

U.S. PATENT DOCUMENTS

2006/0182477 A1* 8/2006 Takiguchi ..... G03G 15/6564
399/396
2011/0052291 A1* 3/2011 Iwakawa ..... B65H 5/34
399/388
2011/0262152 A1* 10/2011 Koizumi ..... B65H 7/02
399/16
2011/0293318 A1* 12/2011 Nakano ..... G03G 15/6511
399/101

* cited by examiner

IMAGE FORMING APPARATUS

CROSS-REFERENCE TO RELATED APPLICATION

This application is a continuation of U.S. patent application Ser. No. 14/764,538, filed on Jul. 29, 2015, which is a National Stage Application of International Application No. PCT/JP2014/000235 filed Jan. 18, 2014, which claims priority from Japanese Patent Application No. 2013-017122, filed Jan. 31, 2013, all of which are hereby incorporated by reference herein in their entirety.

TECHNICAL FIELD

The present invention relates to an image forming apparatus.

BACKGROUND ART

Image forming apparatuses, such as copying machines and printers, include a feeder unit that feeds a sheet and a separating unit that separates a sheet to be fed by the feeder unit one by one and an image forming unit that forms an image on the sheet separated and conveyed to the image forming unit.

In general, a plurality of roller pairs are provided between the separating unit and the image forming unit. However, PTL 1 describes an image forming apparatus having only a registration roller pair (hereinafter simply referred to as a "resist roller pair") between a separating unit and an image forming unit (a secondary transfer roller).

CITATION LIST

Patent Literature

[PTL 1] Japanese Patent No. 4697320

SUMMARY OF INVENTION

Technical Problem

When a sheet is conveyed using the resist roller pair disposed downstream of the separating unit, the conveyance speed by the resist roller pair is decreased since the resist roller pair is subjected to the load applied by the separating unit (hereinafter also referred to as "back tension"). In addition, after the trailing edge of the sheet passes through the separating unit, the back tension disappears. Accordingly, the conveyance speed by the resist roller pair increases.

As described above, if the conveyance speed by the resist roller pair varies, an image transferred by the secondary transfer roller may have a negative impact (image artifacts). In addition, the variation in the conveyance speed of the resist roller pair caused by the back tension is prominent in a configuration in which a conveyance roller other than the resist roller pair is not disposed between the separating unit and the image forming unit.

Accordingly, the present invention provides an image forming apparatus that reduces image artifacts caused by the back tension applied by the separating unit.

Solution to Problem

According to an aspect of the present invention, an image forming apparatus includes a feeder unit configured to feed a sheet, a separating unit configured to separate the sheets fed by the feeder unit one by one, a conveying unit disposed downstream of the separating unit and configured to convey the sheet, an image forming unit disposed downstream of the conveying unit and configured to convey the sheet while forming an image on the sheet, a drive unit configured to drive the conveying unit, and a control unit configured to control the drive unit. The control unit reduces a conveyance speed of the sheet conveyed by the conveying unit after the conveyed sheet reaches the image forming unit.

Further features of the present invention will become apparent from the following description of exemplary embodiments with reference to the attached drawings.

DESCRIPTION OF EMBODIMENTS

[First Embodiment]

[Configuration and Operation of Color Image Forming Apparatus]

Figure 1:
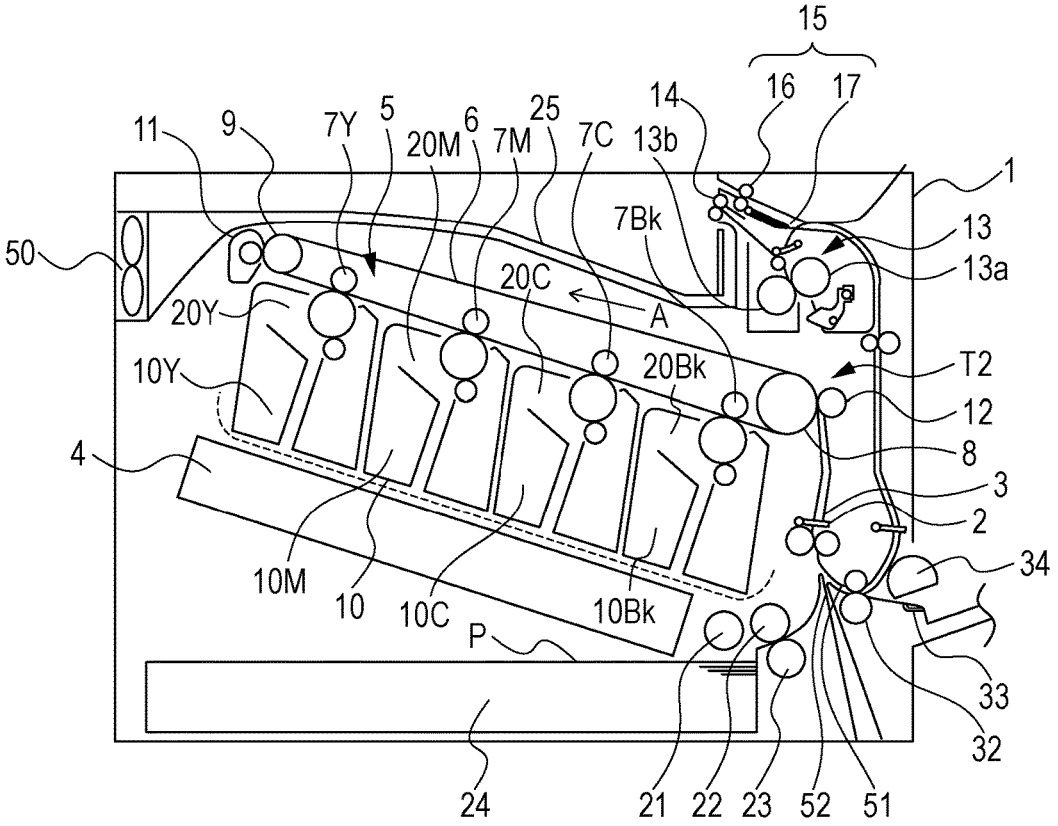
FIG. 1 is a cross-sectional view of a configuration according to a first embodiment.

A color laser beam printer 1 serving as an image forming apparatus according to a first embodiment of the present invention is described first with reference to FIG. 1. FIG. 1 is a longitudinal sectional view illustrating the configuration of the color laser beam printer 1.

The printer 1 includes a feeding cassette 24 in a lower section of the apparatus body. A registration roller pair 2 (hereinafter referred to as a "resist roller pair 2") and a top sensor 3 are disposed above the feeding cassette 24. The resist roller pair 2 conveys a sheet P fed from the feeding cassette 24 in synchronization with an image. The top sensor 3 serves as a detecting unit for detecting the position of the sheet P and the occurrence of jamming.

A scanner unit 4 is disposed above the feeding cassette 24. Four process cartridges 10 (10Y, 10M, 10C, and 10Bk) are disposed above the scanner unit 4. An intermediate transfer unit 5 is disposed above the process cartridges 10 so as to face the process cartridges 10 (10Y, 10M, 10C, and 10Bk). The intermediate transfer unit 5 includes primary transfer rollers 7 (7Y, 7M, 7C, and 7Bk), a drive roller 8, a tension roller 9, and a cleaning unit 11 inside an intermediate transfer belt 6. A secondary transfer roller 12 is disposed on the right of the intermediate transfer unit 5 so as to face the drive roller 8. A fixing unit 13 is disposed above the intermediate transfer unit 5 and the secondary transfer roller 12. An ejection roller pair 14 and an inverse unit 15 are disposed on the upper left of the fixing unit 13. The inverse unit 15 includes a reversing roller pair 16 and a flapper 17 serving as a branching unit.

The image forming operation performed by the printer 1 is described below.

As illustrated in FIG. 1, the printer 1 sequentially transfers toner images of different colors formed on photoconductive drums 20 (20Y, 20M, 20C, and 20Bk) using the scanner unit 4 onto the intermediate transfer belt 6 that rotates in a counterclockwise direction (an A direction) (primary transfer) so that the toner images of different colors are overlaid. In this manner, a full-color toner image is formed on the intermediate transfer belt 6.

A sheet P stored in the feeding cassette 24 is picked up by a pickup roller (a feeder roller) 21 and is separated from other sheets P by a feed roller 22 and a separation roller 23. Thereafter, the sheet P is conveyed to the resist roller pair 2.

The leading edge of the sheet P conveyed to the resist roller pair 2 is detected by the top sensor 3 disposed downstream of the resist roller pair 2 in the conveyance direction. If the leading edge is detected by the top sensor 3, the conveyance speed of the resist roller pair 2 is increased or reduced. In this manner, the sheet P is conveyed to a transfer position T2 in synchronization with the position of the toner image formed on the intermediate transfer belt 6. At the transfer position T2, the sheet P is nipped by the intermediate transfer belt 6 and the secondary transfer roller 12 and is conveyed at a constant speed. Thus, the toner image is transferred to the sheet P. Thereafter, the sheet P having the toner image transferred thereonto at the transfer position T2 is conveyed to the fixing unit 13.

The fixing unit 13 fixes the toner image transferred to the sheet P to the sheet P using a pressure roller 13*a* and a heating roller 13*b*. The sheet P having the toner image fixed thereto is ejected onto an ejecting tray 25 located in the upper section of the apparatus by the ejection roller pair 14.

Figure 2:
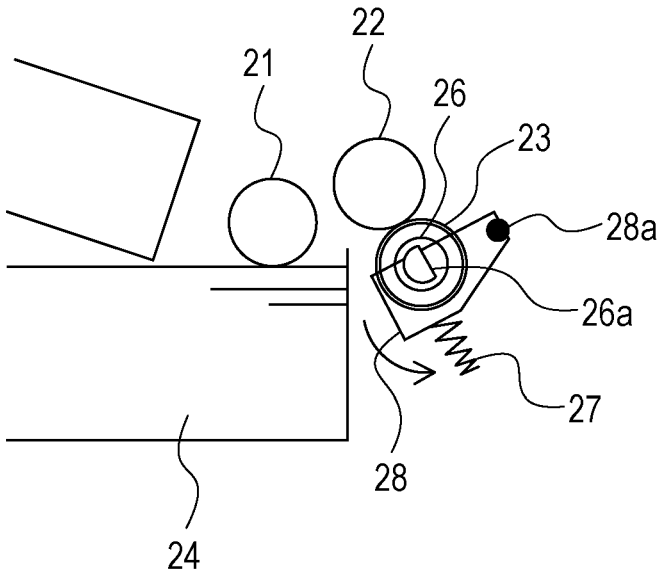
FIG. 2 is a cross-sectional view illustrating the configurations of a feeder unit and a separating unit according to the first embodiment.

FIG. 2 is a cross-sectional view illustrating the configuration of the separating unit for separating a sheet fed by the feeder unit from another sheet one by one.

The pickup roller 21 serving as the feeder unit feeds the sheet P stored in the feeding cassette 24. When the feeding cassette 24 is mounted in the image forming apparatus and if a feed drive unit is driven, the pickup roller 21 is in contact with one of the sheets P at all times. The pickup roller 21 picks up and feeds the sheet P to a separation nip N formed by the feed roller 22 and the separation roller 23. The feed roller 22 is disposed downstream of the pickup roller 21. The sheet P is conveyed by the feed roller 22 toward the resist roller pair 2.

According to the present embodiment, the feed roller 22 and the separation roller 23 form the separating unit for separating a sheet P from another sheet P. As illustrated in FIG. 2, the separation roller 23 includes a torque limiter 26 inside the roller. The torque limiter 26 includes a shaft unit 26*a* having a D shape. The shaft unit 26*a* is unrotatably attached to a holder 28. The holder 28 is rotatable about a rotation center 28*a*. The separation roller 23 is urged against the feed roller 22 by a compressed spring 27 via the holder 28. When the sheet P is nipped by the feed roller 22 and the separation roller 23, the separation roller 23 rotates in a direction indicated by an arrow illustrated in FIG. 2 (a counterclockwise direction) due to the thickness of the sheet P.

Figure 3A:
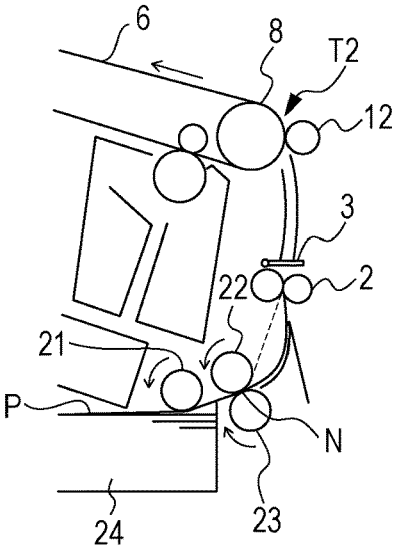
FIG. 3A is a cross-sectional view illustrating the conveyance operation of a sheet according to the first embodiment.
Figure 3B:
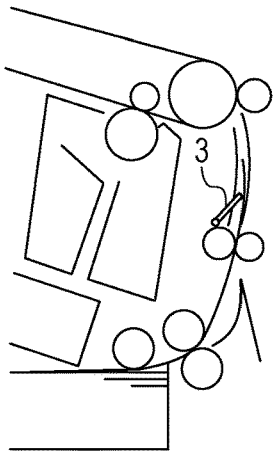
FIG. 3B is a cross-sectional view illustrating the conveyance operation of a sheet according to the first embodiment.

As illustrated in FIGS. 3A to 3B, when the feed roller 22 rotates and if a single sheet is conveyed, the separation roller 23 drivenly rotates in a clockwise direction in accordance with the movement of the conveyed sheet. In contrast, when a plurality of stacked sheets P are fed by the pickup roller 21, the separation roller 23 does not rotate. In this manner, the sheets P are separated into individual sheets.

The pickup roller 21, the feed roller 22, and the resist roller pair 2 are driven by a motor M1 serving as a drive source. At that time, the driving force supplied from the motor M1 is connected to (turned ON) or disconnected from (turned OFF) the pickup roller 21 and the feed roller 22 using an electromagnetic clutch C serving as a clutch unit (refer to FIG. 7).

The intermediate transfer belt 6 of the intermediate transfer unit 5 is rotated in a direction illustrated by an arrow in FIG. 3A by the drive roller 8 that is driven by a motor M2, which is a drive source other than the motor M1.

Figure 7:
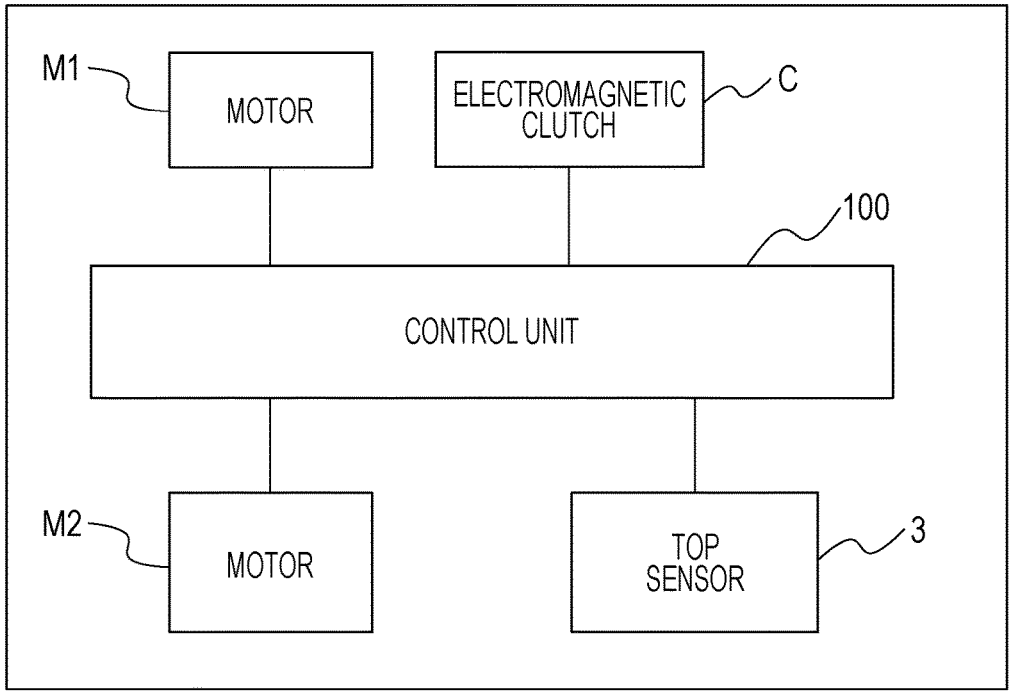
FIG. 7 is a block diagram of the first embodiment.

FIG. 7 is a block diagram of the first embodiment. A control unit 100 of the printer 1 is connected to the motor M1, the motor M2, the top sensor 3, and the electromagnetic clutch C.

Figure 3C:
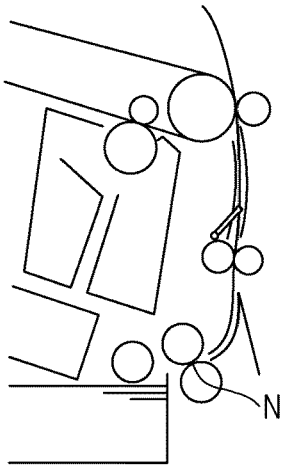
FIG. 3C is a cross-sectional view illustrating the conveyance operation of a sheet according to the first embodiment.

FIGS. 3A to 3C illustrate the sheet P conveyed by a sheet conveyance device according to the first embodiment. Control of conveyance of the sheet P is described below with reference to FIGS. 3A to 3C, timing diagrams illustrated in FIGS. 4 to 6, and a flowchart illustrated in FIG. 14.

Figure 6:
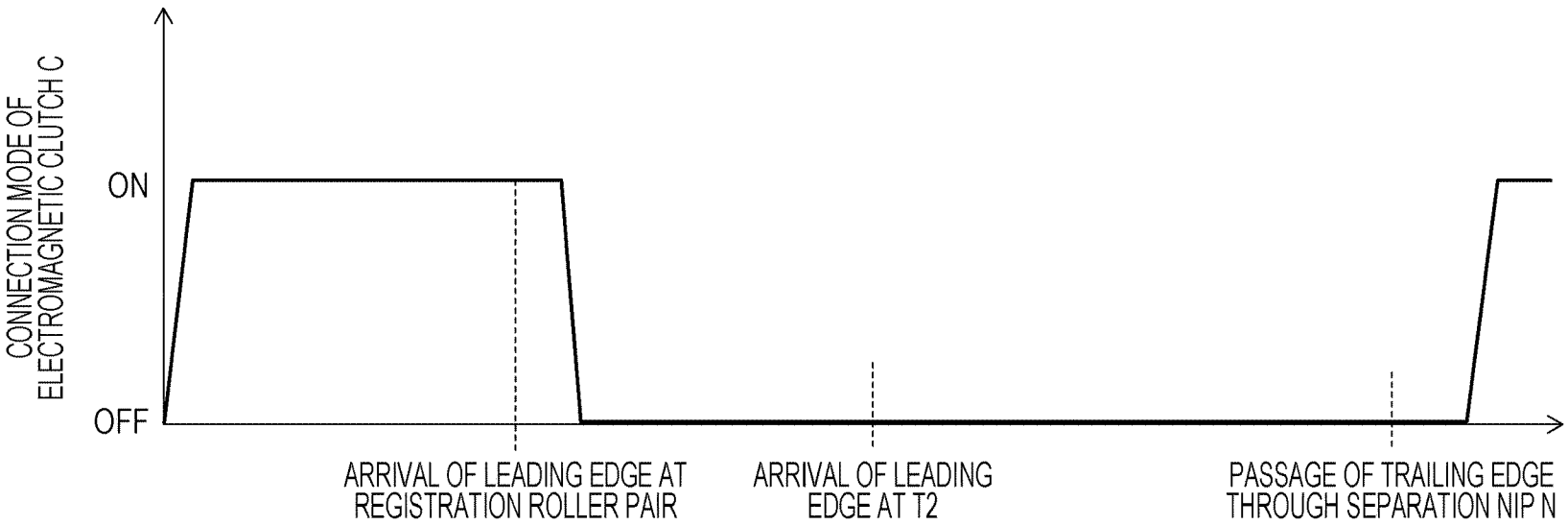
FIG. 6 illustrates the operation performed by an electromagnetic clutch C according to the first embodiment.

The control unit 100 turns on the electromagnetic clutch C at a point in time illustrated in FIG. 6. Thus, as illustrated in FIG. 3A, each of the pickup roller 21 and the feed roller 22 rotates in a counterclockwise direction (S1 in FIG. 14).

As illustrated in FIG. 3A, the sheet P is conveyed toward the resist roller pair 2 by the pickup roller 21 and the feed roller 22. Since a conveyance path between the separation nip N and the resist roller pair 2 is curved, the sheet P is conveyed wile forming a partial loop or an arch (hereinafter simply referred to as a "loop").

After the leading edge reaches the resist roller pair 2, the sheet P is conveyed by the feed roller 22 and the resist roller pair 2. Let Vf be the conveyance speed of the sheet P in the separation nip N, and let Vr1 be the conveyance speed of the sheet P conveyed by the resist roller pair 2. Then, according to the first embodiment, Vf and Vr1 are set so that Vf>Vr1. Accordingly, the loop formed in the sheet P between the separation nip N and the resist roller pair 2 is gradually flattened out due to a speed difference between Vf and Vr1, and the loop enters a mode illustrated in FIG. 3B.

Figure 14:
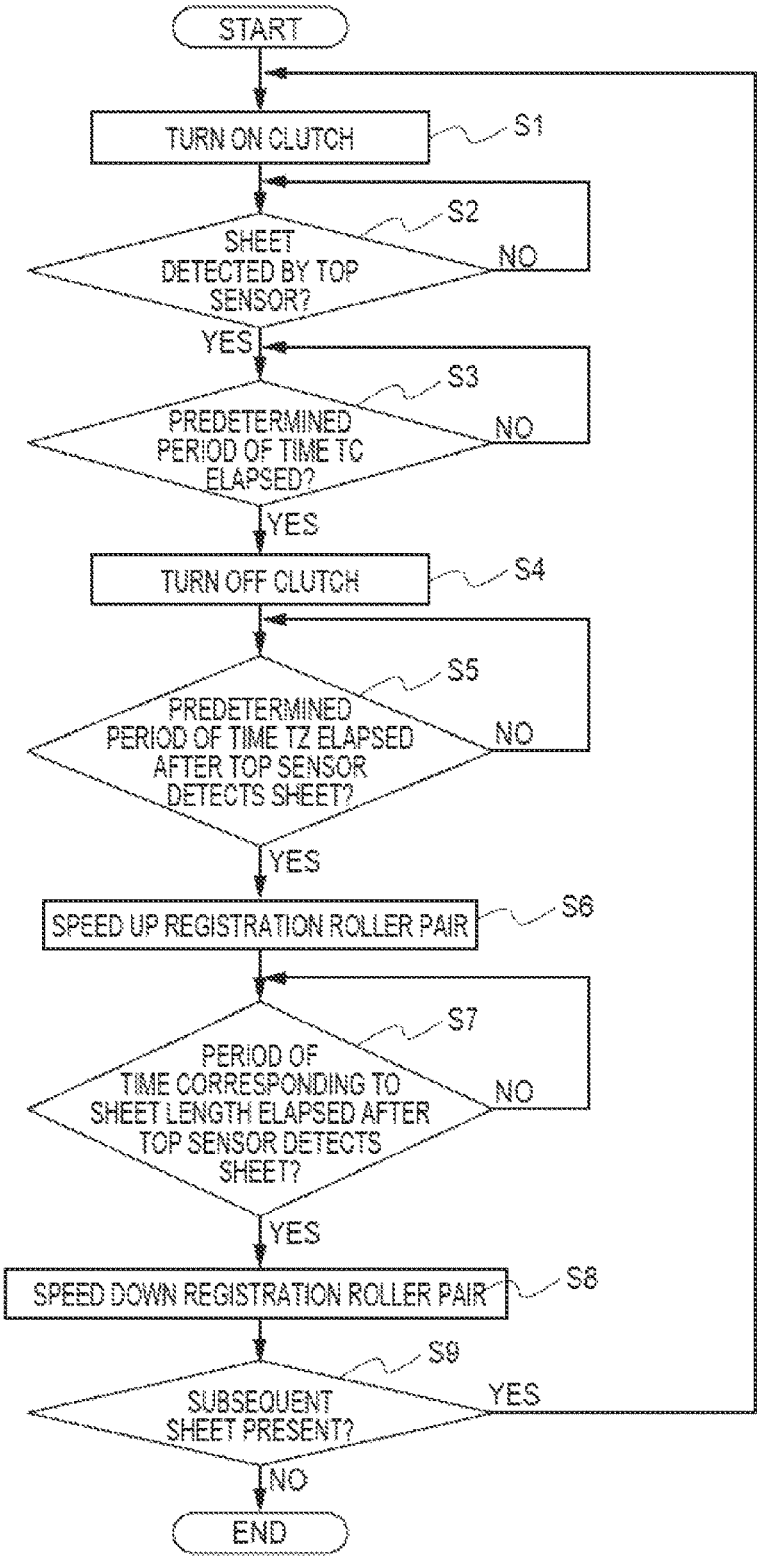
FIG. 14 is a flowchart according to the first embodiment.

The top sensor 3 disposed downstream of the resist roller pair 2 detects that the leading edge of the sheet P passes thereby (S2 in FIG. 14). After a predetermined period of time TC has elapsed since the detection of the leading edge of the sheet P by the top sensor 3 (S3 in FIG. 14), the control unit 100 turns off the electromagnetic clutch C at a point in time illustrated in FIG. 6 (S4 in FIG. 14). Since the electromagnetic clutch C is turned off, transfer of a driving force from the motor M1 to the pickup roller 21 and the feed roller 22 is stopped.

Note that according to the first embodiment, each of the pickup roller 21 and the feed roller 22 includes a one-way gear. Accordingly, even when transfer of a driving force to the pickup roller 21 and the feed roller 22 is stopped, the pickup roller 21 and the feed roller 22 drivenly rotate in accordance with the movement of the sheet P. Consequently, the motor M1 that drives the resist roller pair 2 does not become overloaded.

In addition, the conveyance speed of the sheet P by the resist roller pair 2 is decreased due to the load applied from the separating unit (the back tension) until the trailing edge of the sheet P passes through the separation nip N. The back tension is caused by the torque limiter 26 disposed inside the separation roller 23. If the resist roller pair 2 is affected by the back tension, slight slippage occurs between the resist roller pair 2 and the sheet P. As a result, the conveyance speed of the sheet P conveyed by the resist roller pair 2 is decreased.

The sheet P is conveyed toward the transfer position T2 of the drive roller 8 and the secondary transfer roller 12 by the resist roller pair 2. As illustrated in FIG. 3C, at the transfer position T2, the drive roller 8 and the secondary transfer roller 12 convey the sheet P in a downstream direction while transferring an image onto the sheet P.

According to the first embodiment, the following situation occurs, depending on the length of the sheet P in the conveyance direction: although the leading edge of the sheet P reaches the transfer position T2 and, thus, an image is transferred onto P as the sheet P is being conveyed, the trailing edge of the sheet P does not pass through the separation nip N. In such a situation, the conveyance speed of the sheet P conveyed by the resist roller pair 2 is affected by the back tension. If the trailing edge of the sheet P passes through the separation nip N, the resist roller pair 2 is not affected by the back tension. Accordingly, the conveyance speed of the sheet P conveyed by the resist roller pair 2 increases.

If the conveyance speed of the sheet P conveyed by the resist roller pair 2 increases, the conveyance speed may be too high for the conveyance speed of the sheet P at the transfer position T2. As a result, an excessively large loop may be formed in the sheet P between the resist roller pair 2 and the transfer position T2. If the loop formed in the sheet P becomes excessively large for a loop space allowed for this section of the conveyance path, the sheet P may be brought into contact with a conveyance guide and, thus, the sheet P may wrinkle. Alternatively, the sheet P may be brought into contact with the surface of the intermediate transfer belt 6 at a position upstream of the transfer position T2 and, thus, a problem, such as image artifacts, may arise.

According to the first embodiment, to prevent such a problem, after the leading edge of the sheet P reaches the transfer position T2, the control unit 100 controls the motor M1 so that the number of rotations (the rotational speed) of the resist roller pair 2 is reduced from V2 to V1. The conveyance speed of the sheet P according to the first embodiment is described in more detail below with reference to FIGS. 4 and 5.

Figure 4:
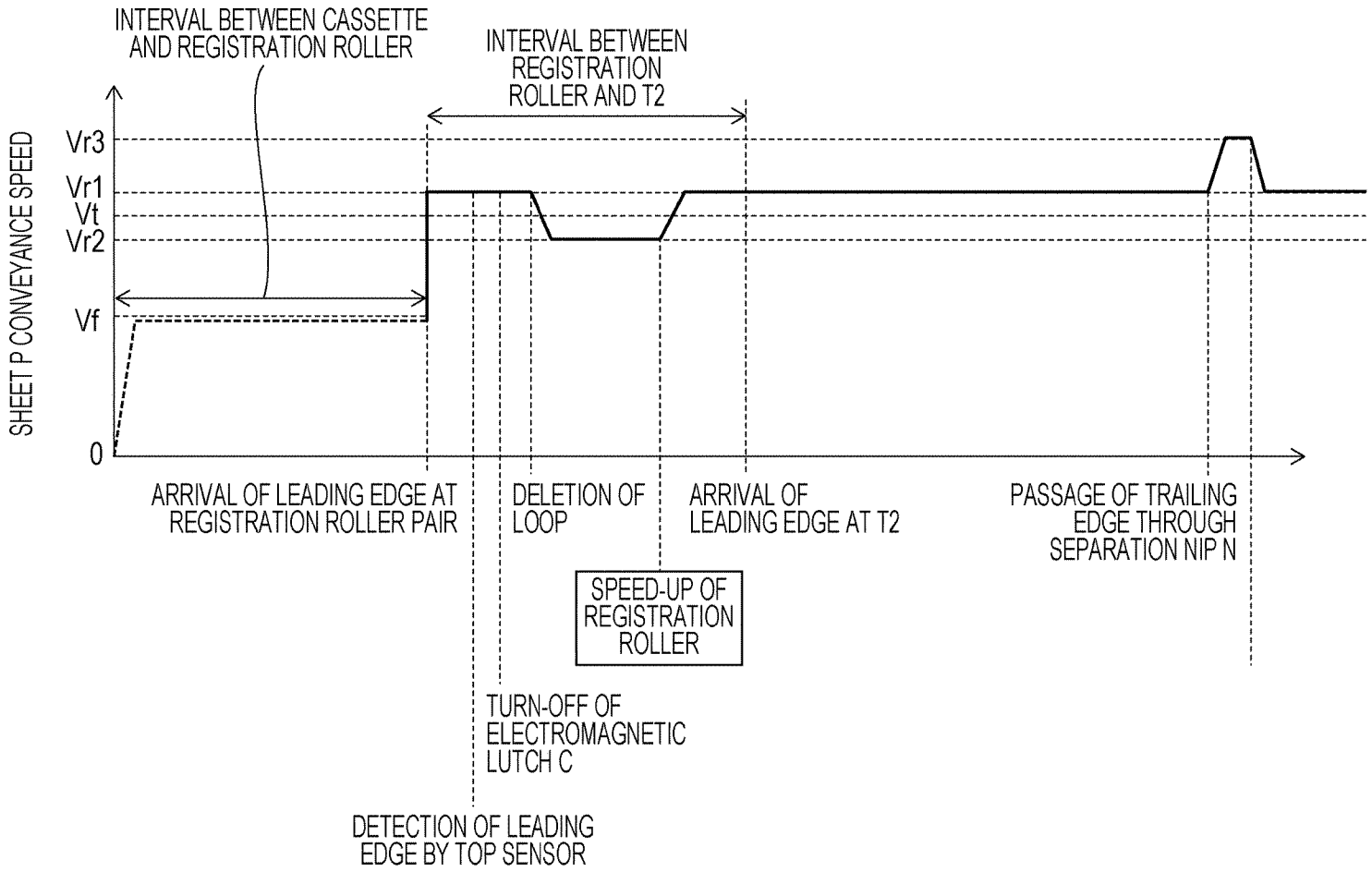
FIG. 4 illustrates the conveyance speed of a sheet conveyed in the first embodiment.
Figure 5:
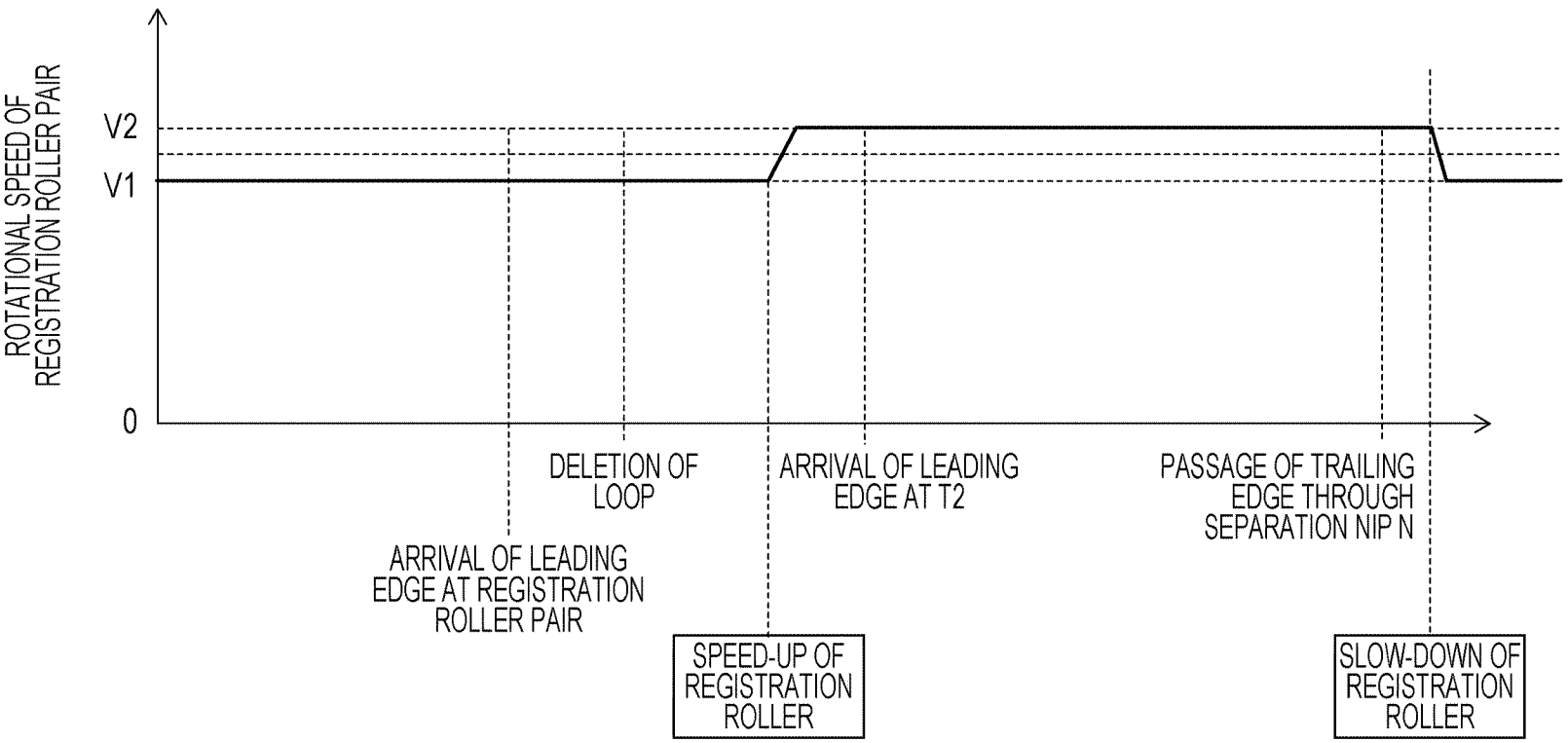
FIG. 5 illustrates the number of rotations (the rotational speed) of a resist roller pair according to the first embodiment.

FIG. 4 illustrates the conveyance speed of the sheet P conveyed in the first embodiment. In FIG. 4, the abscissa represents a time, and the ordinate represents the conveyance speed of the sheet P. A dashed line indicates the conveyance speed of the sheet P conveyed by the pickup roller 21 and the feed roller 22. A solid line indicates the conveyance speed of the sheet P conveyed by the resist roller pair 2. FIG. 5 illustrates a relationship between the number of rotations (the rotational speed) of the resist roller pair 2 and a time.

The sheet P in the feeding cassette 24 is picked up by the pickup roller 21 and is conveyed by the feed roller 22 at a speed of Vf. If the leading edge of the sheet P reaches the resist roller pair 2, the sheet P is conveyed by the resist roller pair 2 at a speed of Vr1. At that time, since a loop of the sheet P is formed between the separation nip N and the resist roller pair 2, a decrease in the conveyance speed of the resist roller pair 2 due to the back tension applied from the separation nip N does not occur until the loop is flattened.

Since the conveyance speed Vr1 by the resist roller pair 2 is higher than the conveyance speed Vf by the feed roller 22, the loop of the sheet P is gradually flattened. If the loop of the sheet P is completely flattened, the conveyance speed of the resist roller pair 2 is decreased due to the back tension applied from the separation nip N. Thus, the conveyance speed is changed from Vr1 to Vr2 (refer to FIG. 5). Note that according to the first embodiment, before the conveyance speed by the resist roller pair 2 is changed from Vr1 to Vr2, the sheet P conveyed by the resist roller pair 2 is detected by the top sensor 3.

Before the leading edge of the sheet P reaches the transfer position T2, the control unit 100 controls the motor M1 so that the conveyance speed of the sheet P by the resist roller pair 2 is increased from Vr2 to Vr1. As illustrated in FIG. 5, the control unit 100 increases the rotational speed of the resist roller pair 2 from V1 to V2. At that time, the time at which the control unit 100 increases the rotational speed of the resist roller pair 2 can be determined in accordance with a time at which the top sensor 3 detects the leading edge of the sheet P. That is, if a predetermined period of time TZ has elapsed after the control unit 100 received, from the top sensor 3, a signal indicating that the leading edge of the sheet P reaches the top sensor 3 (S5), the control unit 100 controls the motor M1 so that the rotational speed of the resist roller pair 2 increases (S6).

As a result, by increasing the conveyance speed Vr1 of the sheet P conveyed by the resist roller pair 2 to higher than a conveyance speed Vt of the sheet P at the transfer position T2, a loop of the sheet P can be formed. In this manner, an effect of the back tension can be eliminated when a toner image is transferred onto the sheet P.

Note that according to the present embodiment, the conveyance speed of a sheet conveyed by the resist roller pair 2 rotating at a rotational speed of V1 without the back tension is the same as the conveyance speed of the sheet conveyed by the resist roller pair 2 rotating at a rotational speed of V2 with the back tension. However, in reality, the two conveyance speeds are not always the same. The two conveyance speeds may differ from each other depending on the characteristics of the apparatus.

If the trailing edge of the sheet P that is conveyed by the resist roller pair 2 at a speed of Vr2 passes through the separation nip N, the effect of the back tension disappears. Thus, the conveyance speed of the sheet P conveyed by the resist roller pair 2 increases to Vr3.

The conveyance speed Vr3 by the resist roller pair 2 is too high for the conveyance speed Vt at the transfer position T2 and, therefore, an excessively large loop of the sheet P is formed between the resist roller pair 2 and the transfer position T2. The excessively large loop may cause the above-described problem.

To solve such a problem, according to the first embodiment, after the trailing edge of the sheet P passes through the separation nip N, the control unit 100 decreases the conveyance speed by the resist roller pair 2 to Vr1. As illustrated in FIG. 5, the control unit 100 decreases the rotational speed of the resist roller pair 2 from V2 to V1. At that time, the time at which the control unit 100 decreases the rotational speed of the resist roller pair 2 can be determined in accordance with a time at which the top sensor 3 detects the leading edge of the sheet P. That is, if a period of time corresponding to the length of the sheet P in the conveyance direction has elapsed after the control unit 100 received, from the top sensor 3, a signal indicating that the leading edge of the sheet P reaches the top sensor 3 (S7 in FIG. 14), the control unit 100 controls the motor M1 so that the rotational speed of the resist roller pair 2 decreases (S8 in FIG. 14).

The control unit 100 can recognize the length of the conveyed sheet P in the conveyance direction on the basis of the size information input to an operation unit of the image forming apparatus by a user or the size information detected by a length sensor in the feeding cassette 24. In addition, the period of time corresponding to the length of the conveyed sheet P in the conveyance direction can be set to a period of time from the time the top sensor 3 detects the leading edge of the sheet P to the time the trailing edge of the sheet P passes through the resist roller pair 2. The period of time is calculated using the above-described size information.

Note that if the accuracy needs to be improved more, the point in time at which the control unit 100 decreases the rotational speed of the resist roller pair 2 may be calculated on the basis of the point in time at which image formation is started.

In this manner, even when the resist roller pair 2 is not subjected to the back tension from the torque limiter 26, the loop of the sheet P formed between the resist roller pair 2 and the transfer position T2 does not become too large. Accordingly, a negative impact on an image formed on the sheet P at the transfer position T2 can be eliminated.

Subsequently, when the control unit 100 sets the rotational speed of the resist roller pair 2 to V1, the next sheet P2 is conveyed to the resist roller pair 2. The control unit 100 determines whether the next sheet to be fed is present (S9 in FIG. 14). If the next sheet is present, the processing returns to S1, where the next sheet is fed.

Note that according to the present embodiment, the rotational speed of the resist roller pair 2 rotating after the trailing edge of the sheet P passes through the separation nip N (after the rotational speed is reduced) is the same as the rotational speed of the resist roller pair 2 before the leading edge of the sheet P reaches the transfer position T2. However, the two rotational speeds need not be the same at all times.

While the present embodiment has been described with reference to a technique in which the rotational speed of the resist roller pair 2 is reduced after the trailing edge of the sheet P passes through the separation nip N, the present invention is not limited thereto. For example, the rotational speed of the resist roller pair 2 may reduced after the leading edge of the sheet P reaches the transfer position T2 and immediately before the trailing edge of the sheet P passes through the separation nip N (i.e., after the point in time immediately before the trailing edge passes through the separation nip N).

That is, if a loop of the sheet P is formed between the resist roller pair 2 and the transfer position T2, a point in time at which the rotational speed of the resist roller pair 2 is stated to reduce may be prior to the point in time at which the trailing edge of the sheet P passes through the separation nip N. In such a case, a loop of the sheet P needs to be formed by, for example, setting the conveyance speed of the sheet P conveyed by the resist roller pair 2 rotating with the back tension to higher than the conveyance speed of the sheet P at the transfer position T2. Note that at that time, the difference between the two conveyance speeds needs to be not too large to prevent the loop from becoming too large.

In addition, while the present embodiment has been described with reference to a technique in which the control unit 100 changes the point in time at which the conveyance speed of the sheet P conveyed by the resist roller pair 2 is started to reduce in accordance with the length of the sheet P in the conveyance direction, the present invention is not limited thereto. For example, the control unit 100 may reduce the conveyance speed of the sheet P conveyed by the resist roller pair 2 after a predetermined period of time elapses since the detection of the sheet P by the top sensor 3, regardless of the length of the sheet P. In such a case, the speed of the resist roller pair 2 needs to be set so that the image formation on the sheet P is not affected by a loop formed between the resist roller pair 2 and the transfer position T2. In addition, the point in time at which the speed of the resist roller pair 2 is started to reduce needs to be set so that even when the image forming apparatus conveys a sheet having the largest conveyable length, image formation is not affected by the sheet P being pulled in a direction opposite to each other between the resist roller pair 2 and the transfer position T2.

As described above, according to the first embodiment, the control unit 100 reduces the number of rotations (the rotational speed) of the resist roller pair 2 after the leading edge of the sheet P reaches the resist roller pair 2. In this manner, as in the first embodiment, image artifacts caused by the back tension applied from the separating unit can be reduced in a compact and low-cost image forming apparatus that does not include a conveyance roller pair between the separating unit and the resist roller pair 2.

Note that while the first embodiment has been described above with reference to a configuration in which the separation roller 23 including the torque limiter 26 is employed as the separating unit that separates sheets fed by the feeder unit one by one, the configuration of the present invention is not limited thereto. For example, a configuration using, as a separating unit, a retard roller that is rotatingly driven in a direction opposite to the rotation of the feed roller may be employed. Any configuration that generates a back tension when sheets are separated can be employed.

[Second Embodiment]

A second embodiment is described with reference to FIGS. 8 and 9. Note that description of the configurations and operations in the second embodiment that are the same as in the first embodiment are not repeated as appropriate.

In the first embodiment, driving of the pickup roller 21 and the feed roller 22 is stopped by turning off the electromagnetic clutch C after the leading edge of a sheet has been conveyed by a predetermined distance since detection of the leading edge of the conveyed sheet by the top sensor 3.

According to the second embodiment, the control unit 100 changes a point in time at which the electromagnetic clutch C is turned off in accordance with the length of the sheet in the conveyance direction. More specifically, the control unit 100 performs control so that the point in time at which the electromagnetic clutch C is turned off for a long sheet is later than that for a short sheet.

Figure 8:
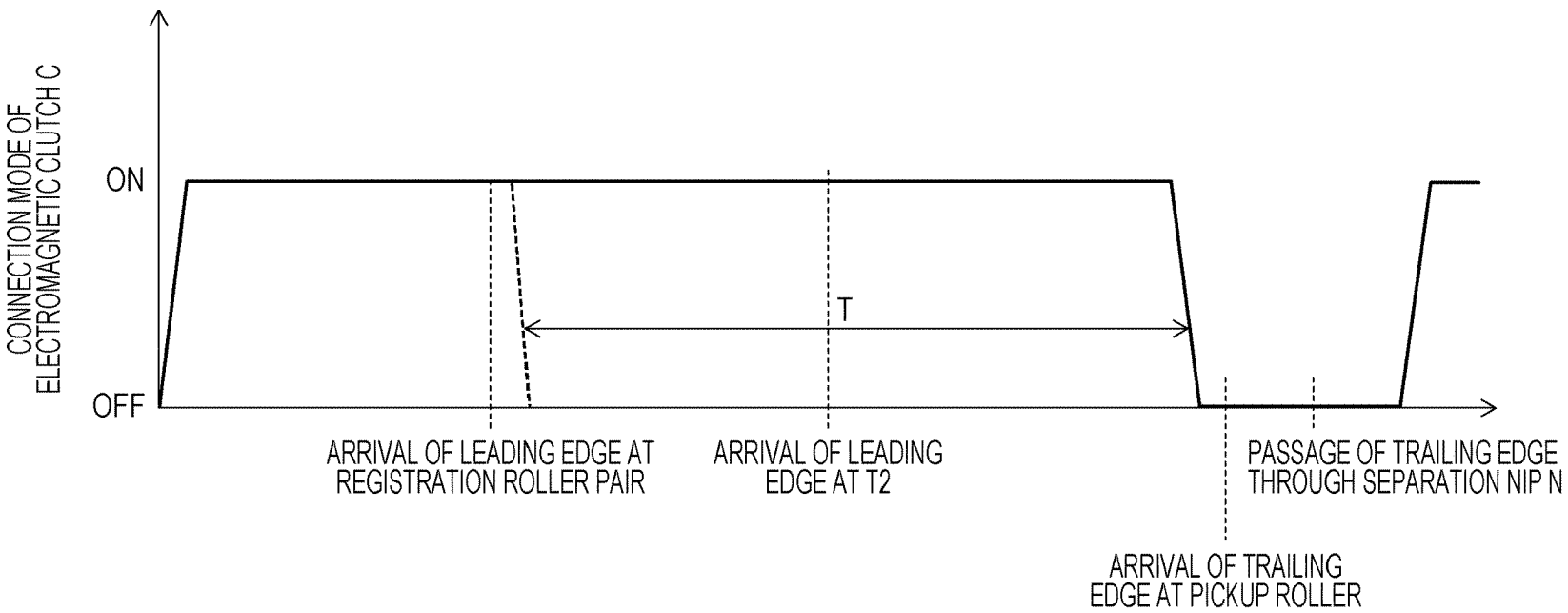
FIG. 8 illustrates the operation performed by an electromagnetic clutch C according to a second embodiment.
Figure 9:
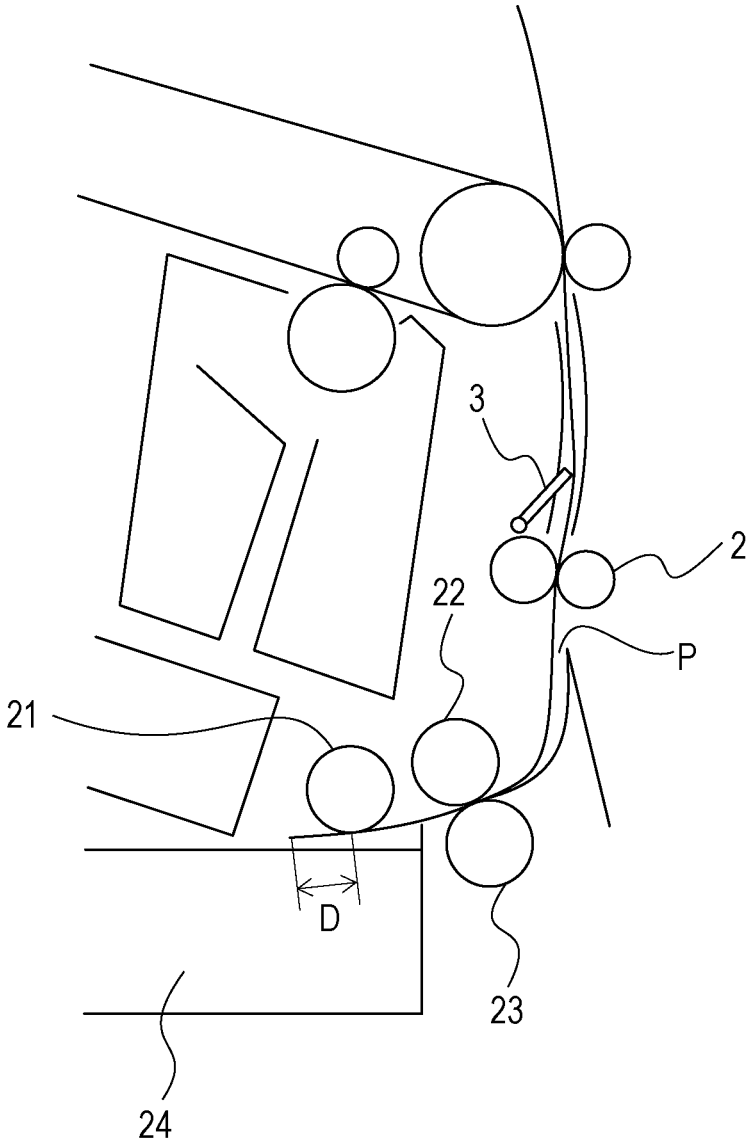
FIG. 9 illustrates the conveyance operation of a sheet according to the second embodiment.

As illustrated in FIGS. 8 and 9, according to the second embodiment, the control unit 100 turns off the electromagnetic clutch C at a point in time at which the trailing edge of the sheet reaches the vicinity of the pickup roller 21 (a distance between the trailing edge of the sheet and the pickup roller 21 is a predetermined distance D, as illustrated in FIG. 9). Note that the control unit 100 can recognize the length of the sheet in the conveyance direction on the basis of the size information input to an operation unit of the image forming apparatus by a user or the size information detected by a length sensor in the feeding cassette 24.

In this manner, as illustrated in FIG. 8, the connection time of the electromagnetic clutch C can be increased from that in the first embodiment by a time T. Accordingly, a period of time during which a back tension is generated can be reduced by the time T. By reducing a period of time during which a back tension is generated, an increase in the rotational speed of the resist roller pair 2 (an increase in time) can be reduced.

Thus, according to the second embodiment, the durability of the resist roller pair 2 can be improved.

[Third Embodiment]

A third embodiment is described next with reference to FIGS. 10, 11, and 12. Note that description of the configurations and operations in the third embodiment that are the same as in the first embodiment are not repeated as appropriate.

While the first embodiment has been described with reference to the configuration in which only the resist roller pair 2 serving as a conveying unit is disposed between the separation nip N and the transfer position T2, the configuration of the present invention is not limited thereto.

Figure 10A:
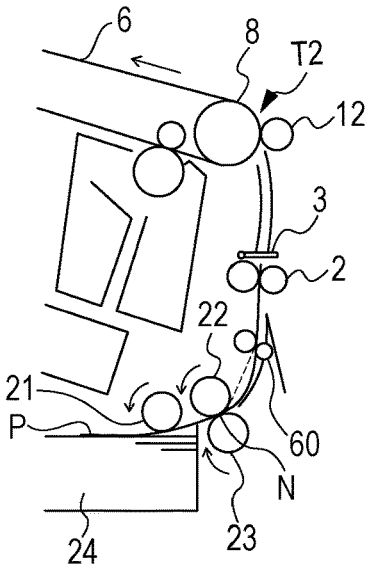
FIG. 10A is a cross-sectional view of the configuration according to a second embodiment.
Figure 10B:
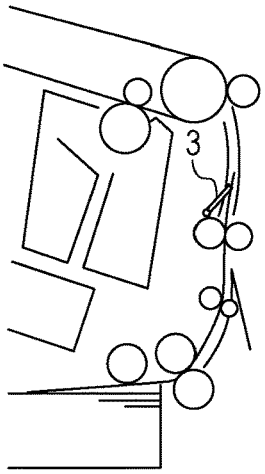
FIG. 10B is a cross-sectional view of the configuration according to the third embodiment.
Figure 10C:
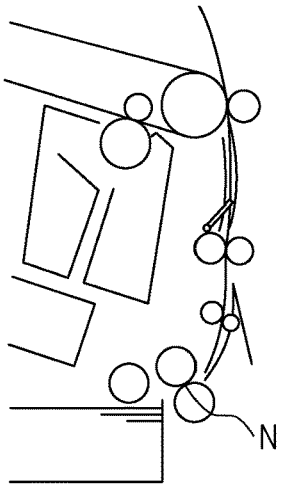
FIG. 10C is a cross-sectional view of the configuration according to the third embodiment.

For example, as illustrated in FIGS. 10A to 10C, in the third embodiment, a conveying roller pair 60 may be disposed between the separation nip N and the transfer position T2 in addition to the resist roller pair 2.

According to the third embodiment, a conveyance speed Vh by the conveying roller pair 60 is set to a speed in the range between a conveyance speed Vr1' by the resist roller pair 2 and the conveyance speed Vf in the separation nip N. That is, according to the third embodiment, the conveyance speed is set so that Vf<Vh<Vr1'.

Even in such a configuration, a negative impact of the back tension in the separation nip N occurs. More specifically, in a mode illustrated in FIG. 10B, the load of the back tension is imposed on the conveying roller pair 60 and, thus, slippage between the sheet P and the conveying roller pair 60 occurs . In addition, the back tension is transferred to the resist roller pair 2 via the sheet P and, thus, slippage between the resist roller pair 2 and the sheet P also occurs.

Figure 11:
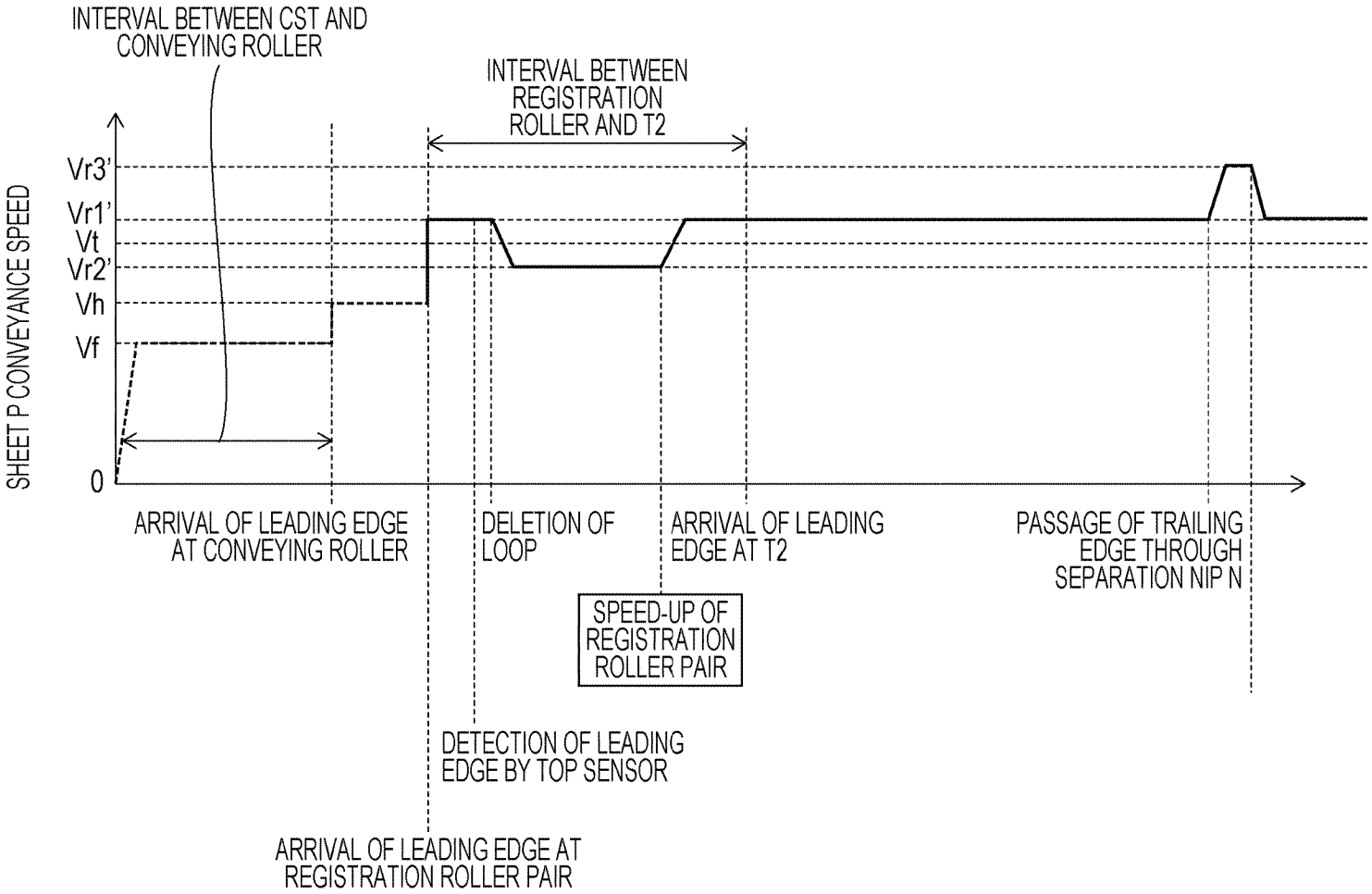
FIG. 11 illustrates the conveyance operation of a sheet according to the third embodiment.
Figure 12:
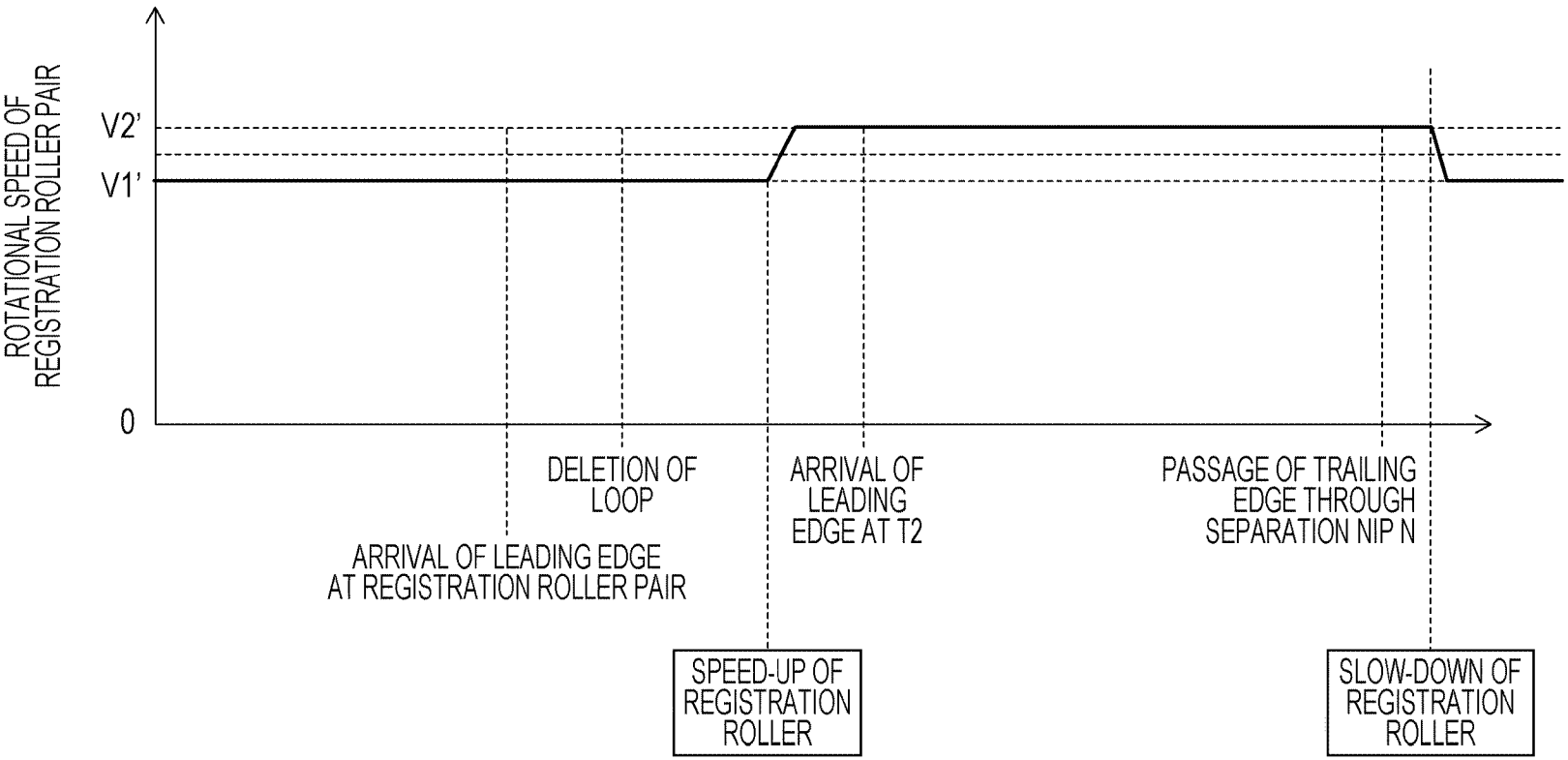
FIG. 12 illustrates the conveyance speed of a sheet conveyed in the third embodiment.

Note that as illustrated in FIGS. 11 and 12, since control of the conveyance speed by the resist roller pair 2 is the same as that in the first embodiment, description of the control is not repeated.

[Fourth Embodiment]

A fourth embodiment is described next. Note that description of the configurations and operations in the fourth embodiment that are the same as in the first embodiment are not repeated as appropriate.

The slip ratio between the resist roller pair 2 and the sheet P caused by the back tension applied from the separating unit may vary depending on the properties (e.g., the thickness and the surface nature) of the sheet P. For example, a gloss paper sheet having a surface friction coefficient higher than that of a plain paper sheet has a low slip ratio with respect to the resist roller pair. Accordingly, the effect of a decrease in the speed caused by the back tension is small.

According to the fourth embodiment, by changing the target speed of the resist roller pair 2 in accordance with the properties of a sheet, the sheet can be conveyed while forming a stable loop between the resist roller pair 2 and the transfer position T2.

Figure 13:
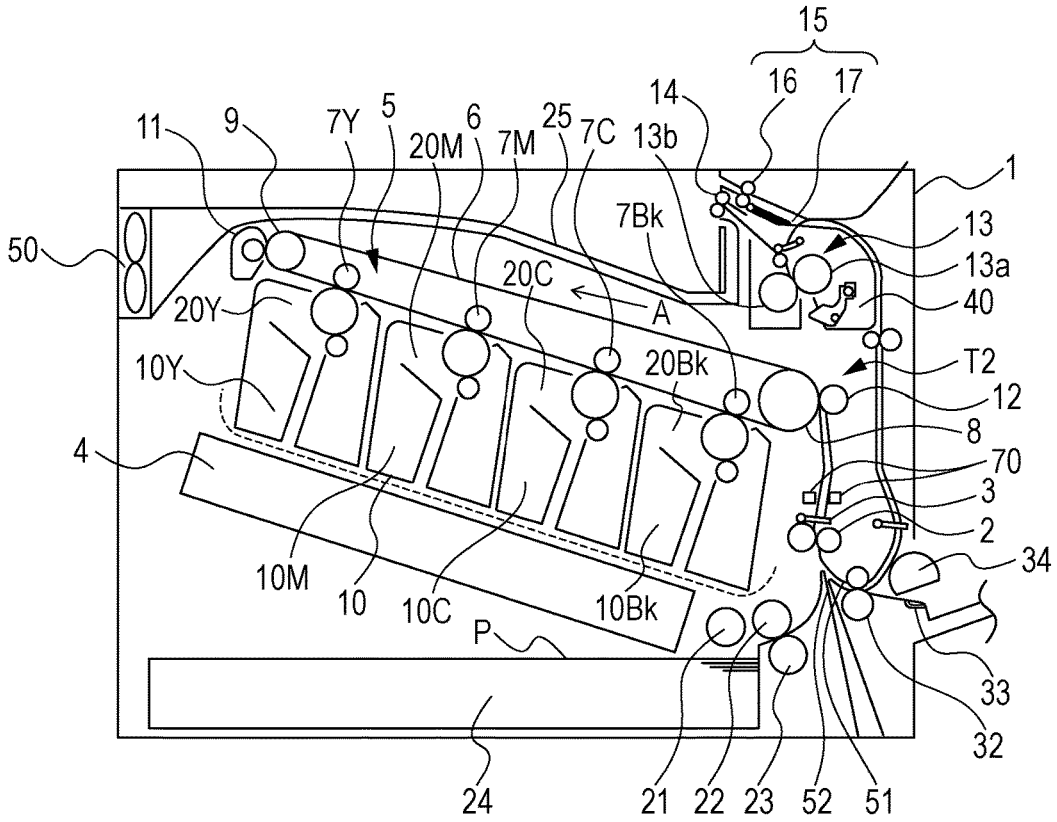
FIG. 13 is a cross-sectional view of a configuration according to a fourth embodiment.

Note that the control unit 100 can recognize the property information of the sheet on the basis of the size information input to an operation unit of the image forming apparatus by a user or information detected in the feeding cassette 24. Alternatively, the control unit 100 may detect the type of sheet using a sheet type detecting sensor unit 70 described in Japanese Patent Laid-Open No. 2010-260662 (refer to FIG. 13). The sheet type detecting sensor unit 70 detects the properties (e.g., the thickness and the surface nature) of the sheet.

In addition, examples of the information regarding the type and the properties of a sheet include the surface nature of the sheet and the thickness of the sheet.

While the above embodiments have been described with reference to an electrophotographic image forming process that forms an image on a sheet, the present invention is not limited to an electrophotographic image forming process. For example, an inkjet image forming process that forms an image on a sheet by ejecting ink liquid from a nozzle may be employed. In addition, while the above embodiments have been described with reference to the configuration in which an image is transferred onto a sheet using an intermediate transfer belt, the present invention is not limited thereto. A configuration in which an image is transferred from a conductive drum to a sheet may be employed.

In addition, the above-described first to fourth embodiments may be combined in any way.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An image forming apparatus comprising:

a feeding member configured to feed a sheet;

a separating member configured to form a nip portion with the feeding member and separate sheets one by one at the nip portion;

a conveying unit disposed downstream of the feeding member in a sheet feeding direction and configured to convey the sheet, wherein a conveyance speed of the sheet by the conveyance unit is faster than a conveyance speed of the sheet by the feeding member and the separating member;

a transfer unit disposed downstream of the conveying unit in the sheet feeding direction and configured to transfer an image formed on an image bearing member onto the sheet while conveying the sheet;

a detecting unit configured to detect the sheet conveyed by the conveying unit; and a control unit configured to control the conveying unit, wherein a trailing edge of the sheet passes through the nip portion after a leading edge of the sheet reaches the transfer unit, and wherein the control unit obtains a point in time at which the trailing edge of the sheet passes through the nip portion based on the detection result by the detecting unit, sets a rotational speed of the conveying unit to a first rotational speed before the point in time, and changes the rotational speed of the conveying unit from the first rotational speed to a second rotational speed that is slower than the first rotational speed after the point in time.

2. The image forming apparatus according to claim 1, wherein the detecting unit is disposed downstream of the conveying unit and upstream of the transfer unit in the sheet feeding direction, and wherein the control unit obtains the point in time at which the trailing edge of the sheet passes through the nip portion based on a point in time at which the detection unit detects the leading edge of the sheet and a length of the sheet in the sheet feeding direction.

3. The image forming apparatus according to claim 1, wherein the control unit determines the rotational speed of the conveying unit based on information about properties of the sheet.

4. The image forming apparatus according to claim 3, wherein the information about the properties of the sheet is information about a surface nature of the sheet or a thickness of the sheet.

5. The image forming apparatus according to claim 1, wherein a conveyance guide between the nip portion and the conveying unit is curved and, at a point in time at which the leading edge of the sheet reaches the conveying unit, a loop of the sheet is formed between nip portion and the conveying unit.

6. The image forming apparatus according to claim 5, wherein, the control unit sets the rotational speed of the conveying unit to a third rotational speed that is slower than the first rotational speed before the loop of the sheet formed between the nip portion and the conveying unit is flattened, and changes the rotational speed of the conveying unit from the third rotational speed to the first rotational speed after the loop of the sheet formed between the nip portion and the conveying unit is flattened.

7. The image forming apparatus according to claim 6, wherein the third rotational speed is equal to the second rotational speed.

8. The image forming apparatus according to claim 1, wherein a loop of the sheet is formed between the conveying unit and the transfer unit before the trailing edge of the sheet passes through the nip portion, wherein an amount of the loop increases due to passing of the trailing edge of the sheet through the nip portion, and wherein the control unit controls the rotational speed of the conveying unit such that the amount of the loop does not become greater than a predetermined threshold.

9. The image forming apparatus according to claim 8, further comprising a conveyance guide for guiding the sheet from the conveying unit to the transfer unit, wherein the control unit controls the rotational speed of the conveying unit such that the sheet does not come into contact with the conveyance guide while the sheet is conveyed by both the conveying unit and the transfer unit.

10. The image forming apparatus according to claim 8, wherein the transfer unit includes a transfer roller and an opposite roller, wherein the transfer roller and the opposite roller form a transfer nip portion, wherein the transfer roller transfers the image formed on the image bearing member onto the sheet at the transfer nip portion, and wherein the control unit controls the rotational speed of the conveying unit such that the sheet does not come into contact with the image bearing member at a position different from the transfer nip portion.

11. The image forming apparatus according to claim 1, wherein the conveying unit is a registration roller pair configured to adjust a point in time of arrival of the sheet at the transfer unit in synchronization with the image formed on the image bearing member, and wherein a roller pair that conveys the sheet is not disposed between the nip portion and the registration roller pair.

12. The image forming apparatus according to claim 1, wherein the conveying unit is a registration roller pair configured to adjust a point in time of arrival of the sheet at the transfer unit in synchronization with the image formed on the image bearing member, the image forming apparatus further comprising a roller pair disposed between the nip portion and the registration roller pair and configured to convey the sheet.

13. The image forming apparatus according to claim 12, wherein a rotational speed of the roller pair is faster than a rotational speed of the feeding member and slower than a rotational speed of the sheet by the registration roller pair.

14. The image forming apparatus according to claim 1, further comprising a motor configured to drive the conveying unit, wherein the feeding member is a feed roller driven by the motor and the separating member is a separation roller that includes a torque limiter and forms the nip portion with the feed roller.

15. The image forming apparatus according to claim 14, further comprising a one-way gear disposed in the feed roller.

16. The image forming apparatus according to claim 14, further comprising a clutch unit configured to connect and disconnect a driving force transferred from the motor to the feed roller.

17. The image forming apparatus according to claim 16, wherein, based on a length of the sheet in the sheet feeding direction, the control unit determines a point in time at which a state in which the clutch unit connects the driving force transferred from the motor to the feed roller is switched to a state in which the clutch unit disconnects the driving force transferred from the motor to the feed roller.

18. The image forming apparatus according to claim 14, further comprising a pickup roller disposed upstream of the feed roller in the sheet feeding direction and configured to pick up a sheet stored in a cassette, wherein the pickup roller is driven by the motor.

19. An image forming apparatus comprising:

a feeding member configured to feed a sheet;

a separating member configured to form a nip portion with the feeding member and separate sheets one by one at the nip portion;

a conveying unit disposed downstream of the feeding member in a sheet feeding direction and configured to convey the sheet, wherein a conveyance speed of the sheet by the conveyance unit is faster than a conveyance speed of the sheet by the feeding member and the separating member;

a transfer unit disposed downstream of the conveying unit in the sheet feeding direction and configured to transfer an image formed on an image bearing member onto the sheet while conveying the sheet;

a detecting unit configured to detect, as a detection result, the sheet conveyed by the conveying unit; and a control unit configured to control the conveying unit, wherein a trailing edge of the sheet passes through the nip portion after a leading edge of the sheet reaches the transfer unit, and wherein the control unit obtains a point in time at which the trailing edge of the sheet passes through the nip portion based on the detection result by the detecting unit, sets a rotational speed of the conveying unit to a first rotational speed, changes the rotational speed of the conveying unit from the first rotational speed to a second rotational speed that is faster than the first rotational speed after the leading edge of the sheet reaches the conveying unit and before the leading edge of the sheet reaches the transfer unit, and changes the rotational speed of the conveying unit from the second rotational speed to a third rotational speed that is slower than the second rotational speed after the point in time.

20. The image forming apparatus according to claim 19, wherein the detecting unit is disposed downstream of the conveying unit and upstream of the transfer unit in the sheet feeding direction, and wherein the control unit obtains the point in time at which the trailing edge of the sheet passes through the nip portion based on a point in time at which the detection unit detects the leading edge of the sheet and a length of the sheet in the sheet feeding direction.

21. The image forming apparatus according to claim 19, wherein the conveying unit is a registration roller pair configured to adjust a point in time of arrival of the sheet at the transfer unit in synchronization with the image formed on the image bearing member, and wherein a roller pair that conveys the sheet is not disposed between the nip portion and the registration roller pair.

* * * * *